United States Patent [19]

Cinque

[11] Patent Number: 4,791,969

[45] Date of Patent: Dec. 20, 1988

[54] CEILING HANGING DEVICE

[76] Inventor: Dean A. Cinque, 80 Broadway, Hillsdale, N.J. 07642

[21] Appl. No.: 132,674

[22] Filed: Dec. 14, 1987

Related U.S. Application Data

[63] Continuation of Ser. No. 871,871, Jun. 6, 1986, abandoned.

[51] Int. Cl.[4] ..... B21F 7/00

[52] U.S. Cl. ..... 140/118; 140/119

[58] Field of Search ..... 140/102.5, 115, 117, 140/118, 119; 16/115, 39; 15/144 B

[56] References Cited

U.S. PATENT DOCUMENTS

| | | | |
|---|---|---|---|
| 561,143 | 6/1896 | Tinsley | 140/117 |
| 1,188,507 | 4/1916 | Kortick | 140/117 |
| 2,046,497 | 7/1936 | Baker | 140/118 |
| 2,096,244 | 10/1937 | Heinrich | 140/117 |
| 2,820,290 | 1/1958 | Porter, Jr. | 15/144 B |
| 2,913,015 | 11/1959 | Cafferata | 140/118 |
| 2,946,356 | 7/1960 | Young | 140/119 |
| 3,030,984 | 4/1962 | Vogt et al. | 140/119 |
| 3,131,731 | 5/1964 | Gulemi | 140/117 |
| 3,380,486 | 4/1968 | Yonan | 140/118 |
| 3,670,784 | 6/1972 | Ackerman | 140/118 |
| 4,188,840 | 2/1980 | Martschinke | 140/118 |
| 4,413,660 | 11/1983 | Conrad | 140/119 |
| 4,694,869 | 9/1987 | Wolford, Jr. et al. | 140/118 |

*Primary Examiner*—Frederick R. Schmidt
*Assistant Examiner*—Robert Showalter
*Attorney, Agent, or Firm*—Weingram & Zall

[57] ABSTRACT

In the hanging of suspended ceilings, a device is provided for enabling wire to be threaded up and over the suspended ceiling support joist and then twisted about itself to a desired length for supporting other portions of the suspended ceiling. The device enables fabrication of suspended ceilings without the need for ladders or scaffolding and allows the workers to accomplish the hanging of the supports from the floor. The device includes a blade portion and a hollow handle portion with an aperture therein. The wire is forced up through the handle via the aperture. The blade portion captures the free end of the wire and, by twisting the handle, forces the free end of the wire about the other portion of the wire, tightening the wire to a desired length. Numerous extension units are provided for the handle so that varying height ceilings can be constructed.

4 Claims, 2 Drawing Sheets

FIG. 1
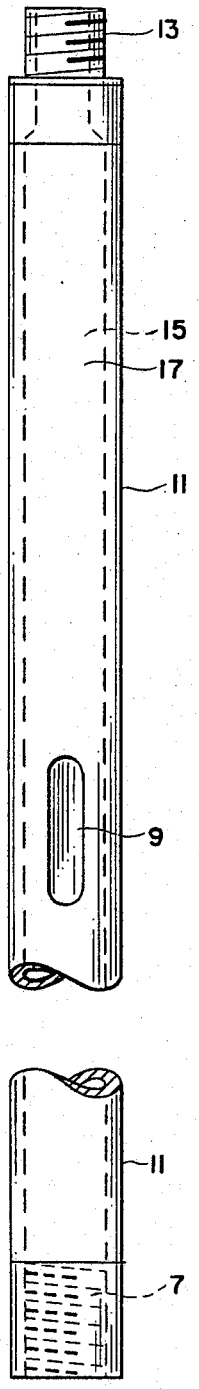
FIG. 1A
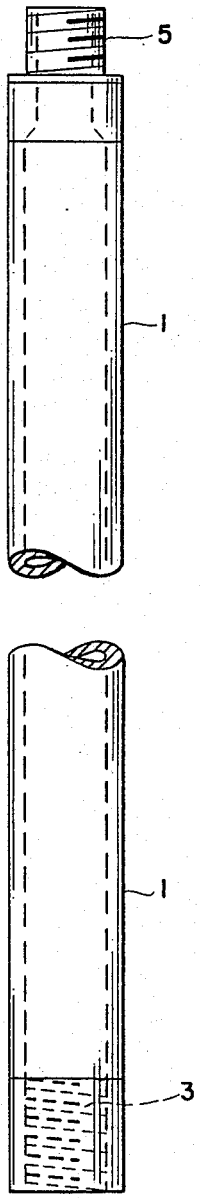
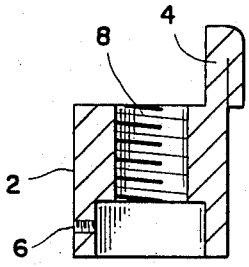
FIG. 3
FIG. 4
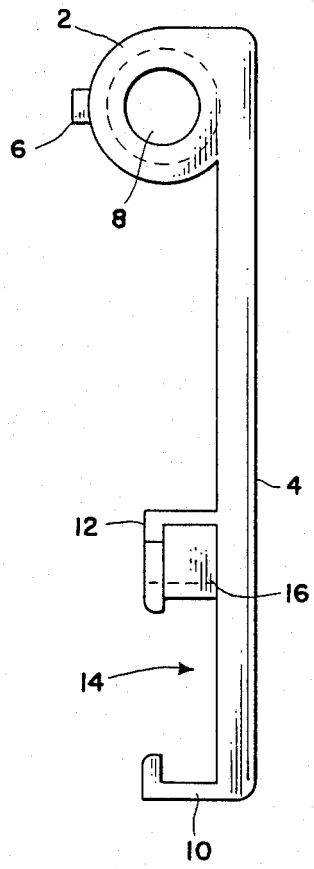

CEILING HANGING DEVICE

This is a continuation of co-pending application, Ser. No. 871,871 filed on June 6, 1986, now abandoned.

BACKGROUND OF THE INVENTION

1. Field of the Invention

The present invention relates to devices which remotely enable the operator to manually twist a wire or other fastener. Specifically, the invention has utility in the hanging of suspended ceilings wherein joist wiring must be installed. The present invention enables the joist wiring to be tied to ceiling joists from the floor without the need of scaffolding or ladders, so as to provide increased productivity and safety.

2. Description of the Prior Art

The present invention relates to suspended ceilings. The steps involved in forming the construction of the modern suspended ceiling involve first the installation of joists which are affixed to the underside of the structural roofing or ceiling of the floor above. The joists thus affixed are then utilized as supports from which additional wire supports are hung so as to form part of the framework for a suspended ceiling. The present invention finds principle utility where wire is required to be first drawn over the fixed ceiling joists and then tied so that a secure length of wire is then provided as a hanging support for the suspended ceiling framework which is, in turn, affixed to the end of the wire. At present, the tying of suspended ceiling wires from the joist requires ladders, scaffolding and more time and effort from the workers needing to climb up and down the ladders or scaffolding to place and then secure the wires to the ceiling joists. Though disclosed and discussed in connection with suspended ceiling installations, it will be clear that the present invention can be utilized wherever it is required to remotely tie one end of a wire about the other to secure that end of the wire to a remote position.

While many patents relate to means for dispensing and securing wire, none were found that are particularly pertinent to applicant's invention since none deal with the two-fold problem solved by applicant's invention, which is the placing of the wire to be tied over a joist and then twisting the free end of the wire about the other end of the wire to secure same.

For example, the patent to Young U.S. Pat. No. 2,946,356 discloses a U-shaped member for tying wire in a hay baler. U.S. Pat. No. 2,096,244 to Heinrich discloses a wire tying arrangement for use in applying and removing tie wires to secure energized electrical conductors to insulators in electrical transmission systems. Other patents disclose hand-held wire tiers include U.S. Pat. Nos. 2,913,015; 3,380,486; 2,046,497; and 1,180,507.

Other patents relating to the wire wrapping of circuits elements on printed circuit boards include U.S. Pat. Nos. 3,670,784; 3,131,731; and 4,188,140.

SUMMARY OF THE INVENTION

The present invention relates to a tool which makes it possible to tie wires to ceiling joists from the ground resulting in increased productivity and increased safety. The invention solves a problem in the installation of suspended ceilings where joist wiring is required to be installed and is so installed without the need of scaffolding or ladders. The time required to set up, climb, relocate, etc. scaffolding and ladders is eliminated and increased safety results as the workers are standing on the ground installing the ceiling wires.

The apparatus of the invention includes a hollow handle which has a feed hole through which the end of the wire is fed and drawn out the top and then bent over. The hollow handle has a tool located at one end thereof so that the tool can be raised and, as the tool is rotated, it catches the bent over wire on the outer tip of the tool. Continued rotation of the tool causes the end portion of the wire to be wrapped around the hanging portion to secure the wire. The angle of wrap depends on the angle of the tool.

Accordingly, a principle object of the present invention is to provide a tool which enables suspended ceilings to be constructed without the need to utilize ladders or scaffolding so as to enable the worker to install the wire hangers forming part of the suspended ceiling.

Another object of the present invention is the provision of a tool which enables wires to be tied remotely from the location of the tying operation.

A further object of the present invention is to enable fastening of wires to be done without the need for any workers to expose themselves to unsafe conditions by eliminating the need for scaffolding or ladders.

Still another object of the present invention is to provide a device with which not only can the wires be secured, but also the wire to be secured can be located over a joist or other location where the wire is to be secured from a remote location without the need for ladders, scaffolding, etc.

Another object of the present invention is to enable a construction process, which involves placement of wires in a ceiling or other remote location, to be accomplished by workers who can stand on the normal flooring of the construction site and place the wires and secure them with the same tool and in one continuous operation.

Another object of the present is to enable the placement and tightening of wire without the need for any complex equipment or without the requirement to utilize any powered device.

Another object of the present invention is to provide the wire placement securing device which is variable in the length so as to enable its use at a variety of heights above the location of the worker.

Another object of the present invention is the provision of a tool which is relatively simple to operate, which is relatively durable, and relatively economical to fabricate.

Another object of the present invention is the provision of a tool which enables wires to be tied remotely from the location of the tying operation which can be operated by a single person without assistance.

BRIEF DESCRIPTION OF THE DRAWINGS

These as well as further objects and advantages of the foregoing invention will be apparent to those skilled in the art from a review of the following detailed description and accompanying drawings in which:

FIGS. 1 and 1A are side view of the hollow supporting pole portion of the present invention and the extension section thereof, respectively;

FIG. 3 is a section view taken along the line 3—3 of FIG. 2 showing the fastening portion of the blade of the invention;

FIG. 4 is a top view of the blade portion of FIG. 2; and

As shown in FIG. 1, the invention includes a hollow pole section 11. this pole section 11 is hollow and has an internal aperture 15 therein. The pole may be formed in extension sections, and one of these extensions is shown at numeral 1 in FIG. 1A. The section extension of FIG. 1A has male and female threaded members 5 and 3, respectively, located at each end thereof. Section 11 in FIG. 1, similarily has male and female threaded portions 13 and 7, respectively formed therein. Each of the male and female threaded portions may be formed of suitable reinforced metal or plastic materials as desired so as to enable them to securely join one extension section with the other so as to provide a hollow pole of adjustable length as required. While each section of the pole is similar, one section, such as shown in FIG. 1, has an aperture 9 formed therein which aperture enables wire to be fed from the exterior of the pole into and through the interior aperture 15 of the pole. As will be seen later, this wire is thus forced up through the pole to the desired location and tightened around the support to which it is desired that the wire be affixed. While each section can be formed with an aperture 9 therein for uniformity of manufacture, it will be clear that at least one of the sections of the adjustable length pole mechanism requires an aperture 9 so as to enable the wire to be inserted and manually forced upward through the entire length of the pole to the desired location for tightening.

FIG. 2 is a side view of the blade portion of the present invention. As shown in FIG. 2, the blade portion consists of a hollow base portion 2 which has internal female threads 8 formed therein. A lock screw 6 is provided to secure the base portion 2 to a male threaded end of the adjustable length pole such as end 13 of pole portion 11 shown in FIG. 1. As can now be seen and especially in connection with FIG. 3, a section view taken along the line 3—3 of FIG. 2, the male end of the pole is secured into the base portion 2 of the blade 4 via engagement of threaded sections 8 and 13 and tightening screw 6 as adjusted to secure the blade 4 to the pole.

Figure 2:
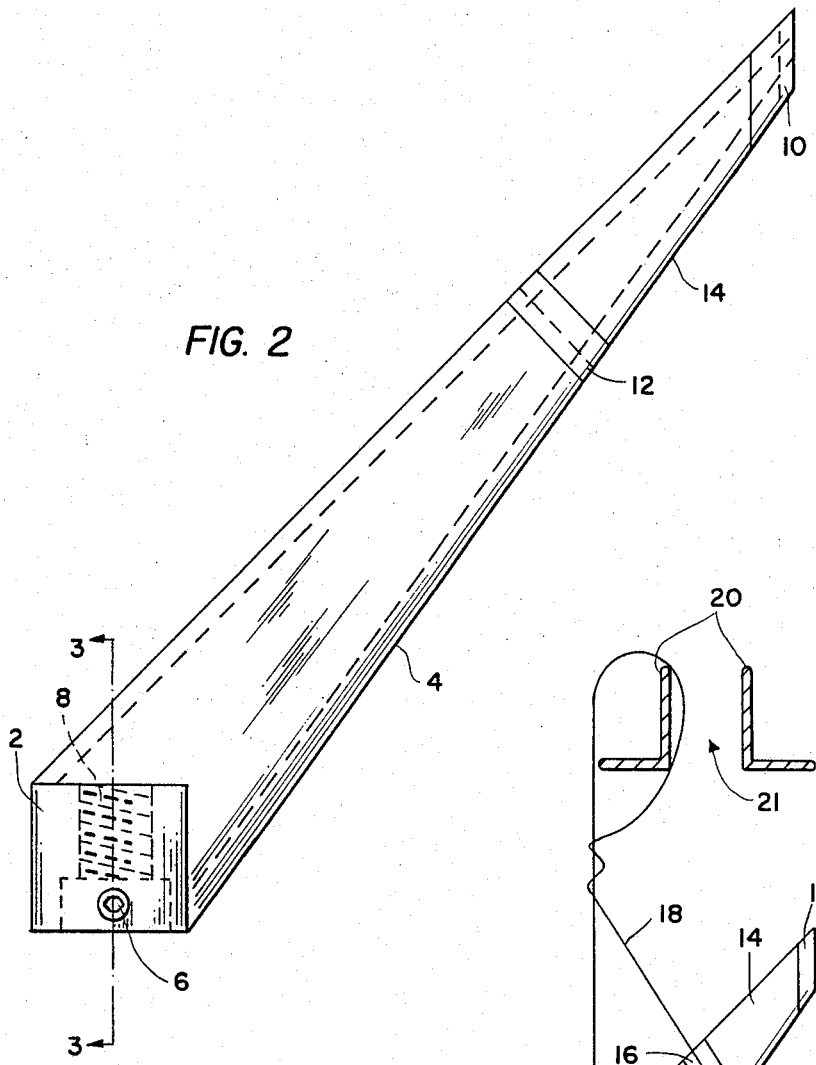
FIG. 2 is a side view of the blade portion of the invention.

As can be seen from FIG. 2, the blade has an elongated, tapered portion 4 which extends at an angle from the horizontal. This tapered portion 4 has an end working portion 14 formed therein.

As best seen in the top view of the blade portion shown in FIG. 4, the end working space 14 is formed by two walls 10 and 12. The wall 10 is formed by an extension of the material of the blade 4 which is configured as an U-shaped hook at the end of the blade. The other wall 12 is formed a distance from the end portion 10 of the blade. This wall 12 is configured at 90° with respect to the perpendicular axis of the blade so as to provide a surface 16 between the outer leg of portion 12 and blade 4. It will be seen, the angle of surface 12 with respect to the perpendicular on the blade portion 4 determines the angle of wrap of the wire.

Figure 5:
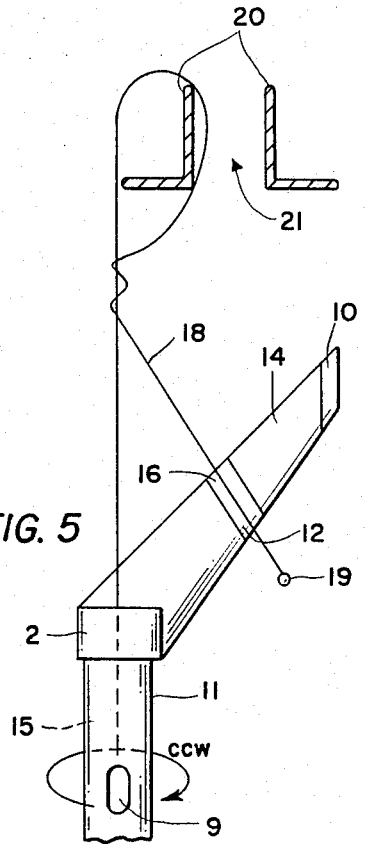
FIG. 5 is a diagramatic representation of the use of the invention.

The device in operation is shown in FIG. 5. As can be seen therein, numeral 18 denotes a predetermined length of wire having a weighted end 19 affixed thereto. The wire and the weight are manually forced upward through the aperture 9 in the section 11 of the handle and up through the center hole 15 of the handle. The weight 19 continues to be forced up through the hollow center of base portion 2 emerging at the outer end of base portion 2. A joist, for example joist 20, used in hanging of suspended ceilings has a space 21 therein. The weighted end of the wire is forced upward through the space 21 of the joist. Now the blade portion 4 is rotated into position and the weighted end of the wire rests between the blade portions 10 and 12 on the angled surface 16. Manual rotation of the blade portion thus tightens the weighted portion of the wire about the remaining portion of the wire. The pole is removed thereby permitting the remaining length of wire to be withdrawn as the entire device is withdrawn from the working position near the bar joist.

It is, of course, apparent that wire 18 need not have a weight 19 on the end thereof for proper operation of the tool. The tool is specifically designed so that wires without weights will still be perfectly suitable. If the end of the wire 18 is unweighted, any tendency for the wire 18 to raise when bent over would be resisted by the L-shaped hook 10 at the end of blade 4. The U-shaped hook 10 at the end of blade 4, as well as the slanted U-shaped wall 12, will tend to capture the end of any wire 18 that has extended through space 21 between the joist and will hold the wire as the tool is rotated counterclockwise to produce the wrapping.

It should also be noted that while the invention is shown having threadable sections to extend the length of the pole, it is clear that there are numerous other devices for extending a pole so that it will be at the desired height for performing the required task. For example, the standard telescoping poles often used with pruning saws to reach branches of trees would be effective.

Further, it should be apparent that the blade can be manufactured with the working end position on the opposite side of the blade so that the walls 10 and 12 would be postioned to enable the blade to function when rotated in the direction opposite from that shown in FIG. 5.

It has been found preferable to have the operative direction of rotation of the blade coincide with the screw threads which fasten the blade to the pole and the pole sections so that upon rotation of the blade in the working direction, the torque exerted on the screw fastenings will tend to tighten them rather than loosen them.

It has also been shown that some form of nonmetallic washer is desirable, such as rubber gaskets to interpose between the separate threaded connections in order to minimize metal to metal contact between the elements of the invention.

It should be noted that it would even be possible to have an embodiment of the invention in which the blade had walls 12 and 10 formed on both sides of the blade to allow its use in rotation either direction.

As modifications to the foregoing may be made without departing from the scope and spirit thereof, the subject matter of my invention for which I desire to obtain letters patent is defined in the appended claims.

I claim:

1. An apparatus for securing wire and for enabling wire to be delivered to a remote location, said apparatus comprising:

a hollow handle;

means for extending the length of said hollow handle;

an aperture in said handle to enable a wire to be located within the hollow interior thereof;

a blade portion affixed to one end of the handle;

said blade portion having a base portion affixed directly to said handle;

said base portion being a generally circular shape and having a hollow central portion so as to enable said wire to be manually forced upwardly through said handle and through said base portion;

an angled blade portion affixed to said base portion, said blade portion extended radially outward from said base portion;

said blade portion having a working portion formed therein;

said working portion being defined between a first wall portion formed by a first U-shaped extension of the blade formed at the end of the blade remote from said base portion and a second wall portion formed by a second U-shaped extension on said blade at a point located between said first wall portion and said base;

said second wall portion being located at an angle with respect to said first wall portion, said second portion defining thereby an angled working surface between the blade and said first wall portion and said working surface adapted to support a wire to tighten same as said blade is rotated.

2. An apparatus for securing wire and for enabling wire to be delivered to a remote location, said apparatus comprising:

a hollow handle having a plurality of sections capable of being affixed to one another to adjust the length of the handle by the number of sections incorporated therein;

an aperture in said handle to enable wire to be located within the hollow interior thereof;

a blade portion affixed to one end of the handle;

said blade portion having a base portion affixed directly to said handle;

said base portion being of generally circular shape and having a hollow central portion so as to enable said wire to be manually forced upwardly through said handle and through said base portion;

an angled blade portion affixed to said base portion, said blade portion extending outwardly from said base portion at an acute angle with respect to the central axis of said hollow portion;

said blade portion having a working portion formed therein between two U-shaped extensions facing each other and connected to said blade;

said working portion being defined by first and second wall portions;

said first wall portion formed by one of said U-shaped extensions and being located in a plane which is parallel to the central axis, said second wall portion formed by the other of said U-shaped blade extensions and being located along said blade at a spaced distance from said first wall portion and being formed at an acute angle with respect to said central axis, said second portion defining thereby an angled working surface facing said first wall portion and;

said working portion adapted to support a wire to tighten same as the blade is rotated.

3. The apparatus of claim 2 wherein said handle portions include a plurality of section handles, each handle portion having a male and female threaded section at opposite ends thereof.

4. The apparatus of claim 3 wherein said circular portion of said blade portion includes a set screw means for tightening said blade to said handle.

* * * * *